US007986214B2

(12) United States Patent
Kahr

(10) Patent No.: US 7,986,214 B2
(45) Date of Patent: Jul. 26, 2011

(54) ELECTRICAL ASSEMBLY WITH PTC RESISTOR ELEMENTS

(75) Inventor: Werner Kahr, Deutschlandsberg (AT)

(73) Assignee: EPCOS AG, Munich (DE)

( * ) Notice: Subject to any disclaimer, the term of this patent is extended or adjusted under 35 U.S.C. 154(b) by 415 days.

(21) Appl. No.: 11/937,098

(22) Filed: Nov. 8, 2007

(65) Prior Publication Data

US 2009/0237199 A1 Sep. 24, 2009

(30) Foreign Application Priority Data

Nov. 10, 2006 (DE) ..... 10 2006 053 081

(51) Int. Cl.
*H01C 7/10* (2006.01)

(52) U.S. Cl. ..... 338/22 R; 338/237; 338/235; 257/703; 257/747

(58) Field of Classification Search ..... 338/22 R, 338/237, 236, 235, 220, 221, 48, 160, 295, 338/320; 257/703, 704, 236, 741, 743, 712, 257/747

See application file for complete search history.

(56) References Cited

U.S. PATENT DOCUMENTS

| | | | |
|---|---|---|---|
| 4,222,024 | A | 9/1980 | Ekowicki |
| 4,823,064 | A | 4/1989 | Prager et al. |
| 4,939,498 | A | 7/1990 | Yamada et al. |
| 5,153,555 | A | 10/1992 | Enomoto et al. |
| 5,210,516 | A | 5/1993 | Shikama et al. |
| 5,382,938 | A | 1/1995 | Hansson et al. |
| 5,504,371 | A | 4/1996 | Niimi et al. |
| 5,798,685 | A | 8/1998 | Katsuki et al. |
| 6,169,472 | B1 | 1/2001 | Kahr |
| 6,933,829 | B2 | 8/2005 | Schopf et al. |
| 2004/0090303 | A1 | 5/2004 | Schopf et al. |
| 2006/0139831 | A1 | 6/2006 | Huemer et al. |

FOREIGN PATENT DOCUMENTS

| | | |
|---|---|---|
| CN | 1140887 | 1/1997 |
| CN | 1481560 | 3/2004 |
| DE | 3905443 | 2/1989 |
| DE | 69114322 | 6/1996 |
| DE | 69122216 | 4/1997 |
| DE | 29720357 | 4/1998 |
| DE | 69424477 | 2/2001 |
| DE | 10243113 | 4/2004 |
| EP | 0443618 | 8/1991 |
| EP | 0487920 | 6/1992 |
| EP | 0994491 | 4/2000 |
| JP | 05-267004 | 10/1993 |
| WO | WO01/52275 | 7/2001 |
| WO | WO02/49047 | 6/2002 |
| WO | WO2004/028126 | 4/2004 |

OTHER PUBLICATIONS

Search Report in Application No. EP07120093.5, dated Dec. 17, 2008.

(Continued)

*Primary Examiner* — Kyung Lee
(74) *Attorney, Agent, or Firm* — Fish & Richardson P.C.

(57) ABSTRACT

An electrical assembly includes at least two PTC-resistor elements, each of which has a base body having a flat shape. Each base body has main surfaces that contain electrodes. A carrier plate has spacers for positioning base bodies of the at least two PTC resistor elements. A width each spacer is about equal, in at least one area, to a distance between facing electrodes of adjacent PTC-resistor elements.

18 Claims, 6 Drawing Sheets

OTHER PUBLICATIONS

Search Report in Application No. EP07120090.1, dated Dec. 17, 2008.
Machine Translation of JP05-267004 (Publication Date Oct. 15, 1993).
Action and Response History in U.S. Appl. No. 11/937,107, as retrieved from PAIR on Sep. 28, 2010.
Examination Report in Chinese Application No. 200710159618.2, dated Aug. 16, 2010.
Action and Response History in U.S. Appl. No. 11/937,107, as retrieved from PAIR on Jan. 5, 2011.

ELECTRICAL ASSEMBLY WITH PTC RESISTOR ELEMENTS

CROSS-REFERENCE TO RELATED APPLICATION

Under 35 U.S.C. §119, this application claims the benefit of a foreign priority application filed in Germany, serial number 102006053081.0, filed Nov. 10, 2006. The contents of German application serial number 102006053081.0 are hereby incorporated by reference into this application as if set forth herein in full.

TECHNICAL FIELD

An electrical assembly comprising a protection device based on PTC resistor elements for removing noise from signal lines is known from the publication DE 10243113 A1, for instance.

BACKGROUND

One problem to be solved is to specify an electrical assembly with small dimensions that constitutes a reliable device for protecting signal lines against overcurrents or high current loads.

SUMMARY

An electrical assembly is specified with a resistor arrangement comprising at least two resistor elements. The resistor elements each have a base body that may include PTC properties, i.e., cold conductor properties. PTC stands for Positive Temperature Coefficient. A relatively thin electrode in the form of at least one electrode layer is arranged on each main surface of the base body.

The assembly further comprises a carrier plate having spacers for positioning the base body and for assuring a predetermined minimum distance between two adjacent resistor elements. The width of the respective spacer is adjusted to be essentially equal in at least one area to the distance between the electrodes facing one another of two adjacent resistor elements.

The base body may comprise a sintered ceramic material based, for example, on barium titanate. In one variant, the base body contains a lead component. With an advantageously selected composition of the ceramic components, it is possible to forgo lead. The lead-free assemblies are particularly environmentally acceptable.

The base body may have a flat overall shape, for instance, that of a disk. The base body can also have a rectangular or some other base shape. The base body may have beveled or rounded edges.

The resistor elements may be oriented on edge and arranged at a relatively short distance from one another. The distance between two adjacent resistor elements is, for example, 1 mm or less.

The base body may have a resistance of 20-100 Ω at room temperature. The breakdown voltage of the base body is, e.g., at least 400 V.

The surface area of the respective electrode is, e.g., less than 0.5 $cm^2$ The electrodes may be made solderable. This can be accomplished with a solderable outer layer of the respective electrode. The solderable outer layer may contain silver.

Long-term stable electrodes with high current-carrying capacity for the resistor elements can be created, for example by a suitable layer sequence. Each electrode comprises a Cr layer as its lowest electrode layer, i.e., the one closest to the base body. An additional electrode layer can contain nickel. The uppermost electrode layer, which may be arranged on the nickel layer, may contain silver and/or tin.

A connection wire is attached to each electrode of the respective resistor element. The connection wire may have a round cross section, which does not rule out a different shaping of the connection wire, however.

The connection wire may be attached to the associated electrode of the resistor element by soldering or, in another variant, by welding. A solder point is distinguished by a stable resistance value over the life of the assembly, and is therefore advantageous. An elevation of the contact resistance and the risk of sparking at the contact point, which can occur between the electrode and the connection wire in case of clamping, is also prevented.

Between adjacent base bodies, at least two separate spacers may be provided, between which the connecting wires facing one another of these resistor elements are arranged.

Openings, through which the connection wires are led, are provided in the carrier plate. The free ends of the connection wires may be bent after insertion of the wired resistor elements in such a manner that they are oriented essentially parallel to the main surface of the carrier plate.

The area of the resistor elements facing the carrier plate may be sunk into a recess formed on the carrier plate. The carrier plate has recesses, each of which is provided to accommodate an area of the respective base body. Each resistor element may be provided with a recess of its own.

With respect to a rolling motion of the resistor element, the recesses of the carrier plate provided for accommodating resistor elements have a stable position with minimal potential energy. For instance, these recesses can have a depth that increases in cross section in both opposing directions from the inside to the outside perpendicular to the thickness direction of the respective resistor element. In the rolling motion of the resistor element, a restoring force arises, which brings it back into the stable position. Thus the disk-like base body is prevented from rolling away.

The bottom of the recess can be formed, for instance, as a part of a cylindrical envelope surface. Two surfaces, planes for instance, running at an angle to the center of the recess are also suitable.

The resistor elements may be electrically isolated from one another, and are provided as current-limiting elements.

In a variant, one resistor element of the assembly is provided per signal line of a telephone extension. Two of the resistor elements are used since a telephone extension has an incoming line and a return line. The resistor elements form protective devices in order to avoid risks, in particular, a line failure, provoked by interference. Even a line carrying power-line voltage can induce overvoltages in the telephone line by contact.

The assembly is used, for example, in the signal line on the input side of an electronic transmission unit located in the telephone station.

The assembly may comprise at least four mutually electrically isolated PTC resistor elements, all of which are arranged on the carrier plate, and whose relative positions are determined by the spacers. It is also possible to provide more than four resistors. Two resistor elements are provided for each telephone connection, i.e., 2N resistor elements for N telephone connections.

The resistor elements may have the same resistance value within permissible tolerances. Narrow tolerance ranges are advantageous in this regard.

The assembly may comprise at least one cover, which can be attached to the carrier plate. The cover may be furnished with attachment devices such as snap-fitting devices. The cover can have at least partially open sides. The cover may be U-shaped in longitudinal section. The cover can have the shape of a cap.

In one variant, the cover and the carrier plate form an open housing. In another variant, the cover and the carrier plate form a closed housing, i.e., a housing with a closed cavity, in which the resistor elements are enclosed.

The cover has centering devices arranged between resistor elements in one variant. The centering devices can be nub-shaped. The length of the respective centering device measured in the longitudinal direction of the assembly is less than the distance between the facing electrodes of adjacent resistor elements. A gap may be provided between the respective resistor element and the centering device. Thickness tolerances in the manufacturing of the resistor elements are thus taken into account. The gap is constructed to be relatively narrow so that, despite a certain margin of variation, the tilting of the resistor elements is prevented by the centering device.

The cover has at least one recess, which is provided to accommodate an upper area of at least one resistor element. In one variant, only one such recess is provided in the upper part of the cover for resistor elements. In principle, each resistor element can be provide with a recess of its own.

With respect to a rolling motion of the resistor element, the recesses of the cover that are provided for accommodating resistor elements have a stable position with minimal potential energy. This recess may have a depth that increases in cross section from the inside to the outside in both opposing directions. This serves to fix the position of the resistor elements transverse to the longitudinal direction of the assembly.

The cover has end walls that are oriented perpendicular to the longitudinal direction of the assembly. Additional recesses may be formed in these end walls. Connecting wires of the endmost resistor elements are arranged in these recesses. It is thus possible to reduce the overall length of the assembly.

In one variant, the resistor elements can be molded into a molding compound. They are initially fixed with the aid of spacers, and are then molded or injection-molded.

The main surfaces facing one another of two adjacent resistor elements and, for instance, two spacers arranged between these resistor elements together define an intermediate space, which has dimensions such that it is sufficient for the accommodation of connecting wires and for maintaining a predetermined minimum distance between electrical contacts of the resistor elements. In particular, this means the minimum distance between mutually opposing solder points.

The linear dimension of the resistor element measured in the longitudinal direction is referred to as its thickness. The overall thickness of the resistor elements is measured between two planes that touch points of the solder joint between the connection wire and the electrode that are maximally far apart from one another. The overall thickness of the resistor element may measure 2 mm or less. The maximum thickness of the resistor element, which is essentially equal to the thickness of the base body, may be 1.5 mm.

The minimum distance between two resistor elements is defined between two planes that touch points of the solder joints of the two elements that are maximally close to one another. This minimum distance, which is also the minimum distance between mutually opposing connection wires of the adjacent resistor elements, may be less than 0.5 mm.

A minimum distance of 0.2 to 0.3 mm can be sufficient to satisfy the requirements with respect to dielectric strength of the assembly. Such tight positioning of resistor elements is made possible in one variant by an electrically insulating envelope of the respective resistor elements, also covering solder points.

The respective spacer in one variant can have an upward-directed narrowing. The spacers thus have a lower area and a narrowed upper area, the lower area being wider than the upper one.

The spacers that contact the respective resistor element form a mounting device for the fixation of the resistor element. This mounting device is designed such that the resistor element is situated rigidly between the lower areas of these spacers. Since the spacers slant outwardly, the resistor element can be inserted particularly easily into the mounting device.

In one embodiment, the carrier plate has at least one cutout, in which an outward-directed connection wire of the respective endmost resistor element is arranged. Such a cutout may be provided for each longitudinally outermost connection wire. This measure, as well as the recesses of the cover, serves to shorten the overall length of the assembly.

The carrier plate may be stepped downward, and thus has a recessed lower area, also called the base area. This allows access to laterally projecting ends of the connection wires from the outside, which is advantageous for testing the installed resistor elements. The stepped area of the carrier plate may extend in the longitudinal direction.

The recessed base area facilitates the testing of the resistor element, even if the contact surfaces of the circuit board on which the assembly is mounted that are provided for making contact with contact areas of the connecting wires are particularly small. It is even provided in one variant that the contact surfaces do not project out of an area of the circuit board that is defined by the footprint of the assembly. This footprint, or the area of the circuit board covered by the assembly, coincides, for example, with the installation surface on the upper area of the carrier plate. Consequently, the reduction of the carrier plate in the sense of miniaturizing an electrical module containing the assembly and the circuit board is particularly advantageous.

The specified assembly and its advantageous configurations will be explained below on the basis of schematic figures, not drawn to scale.

DETAILED DESCRIPTION

Figure 1:
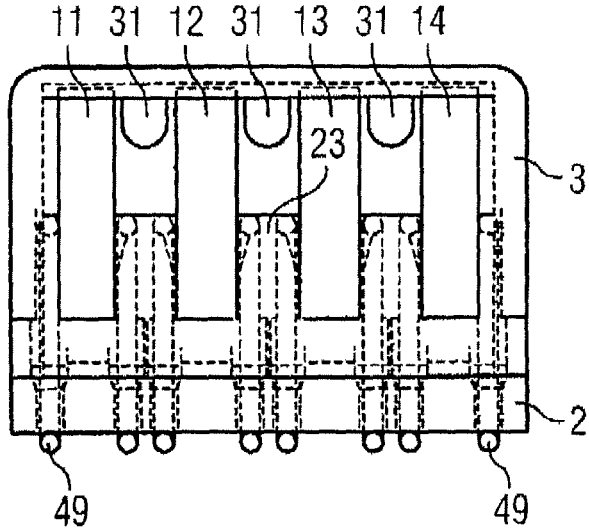
FIG. 1 shows a first side view of the assembly with four resistor elements that are arranged on a carrier plate.

From a number of similarly constructed components of the assembly shown in the figures, only one component will be described for the sake of simplicity. The description applies to all components of the respective type, however. This applies, in particular, to resistor elements 11, 12, 13, 14, spacers 23, 24, soldering points 5, connection wires 41, 42, base body 15, centering devices 31, recesses 27, 29, 38, 39, cutouts 26 and openings 28.

The assembly with resistor elements, a carrier plate and a cover is presented in FIGS. 1, 2C and 3-7. Different views of the carrier plate are shown in FIGS. 8-12. Different views of the cover are shown in FIGS. 13-17.

The assembly comprises a carrier plate 2, on which four resistor elements 11, 12, 13, 14 oriented upright are arranged. The main surfaces of the resistor elements are oriented parallel to one another.

The resistor elements are positioned or held between spacers 23, 24, which may be part of the carrier plate or fixedly connected thereto. The resistor elements in the end positions are each positioned by at least one of spacers 23, 24 and a wall of carrier plate 2.

Figure 4:
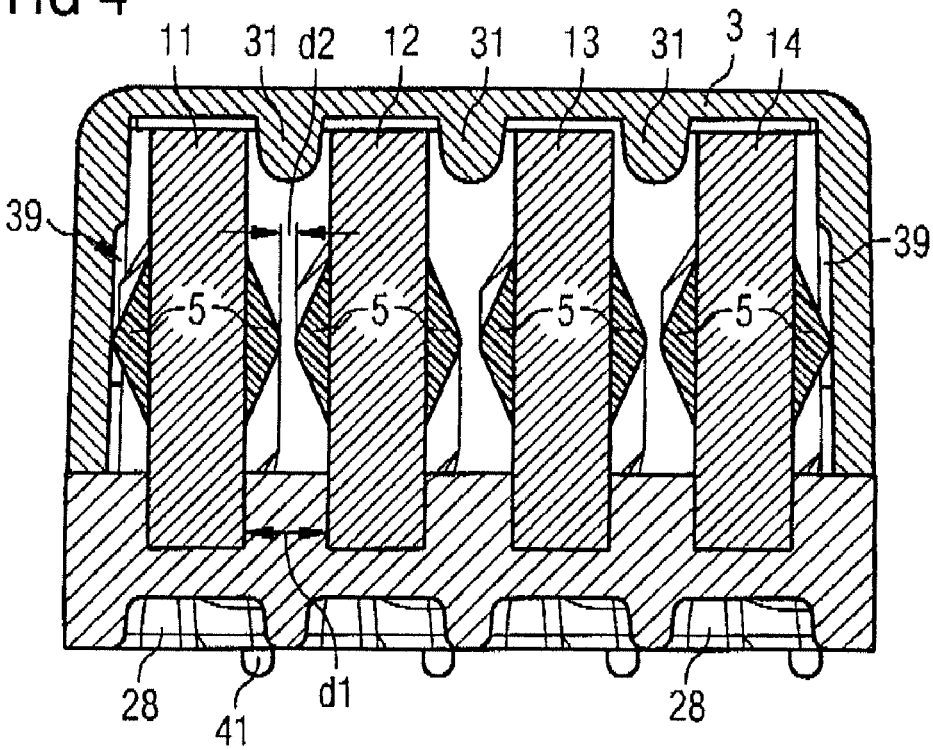
FIG. 4, the assembly according to FIG. 1 in a longitudinal section.

Spacers 23, 24 each have a width dl, which is essentially equal to the distance between the main surfaces of the adjacent resistor elements, see FIG. 4.

Figure 2A:
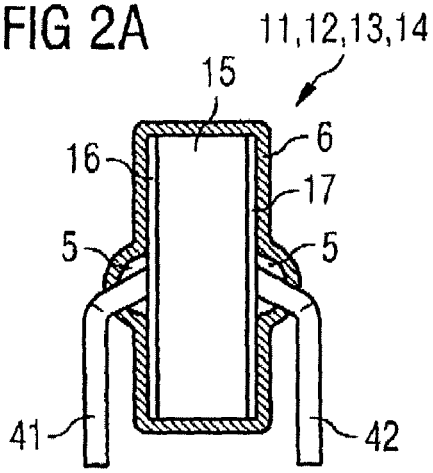
FIGS. 2A, 2B, various views of a disk-shaped resistor element.
Figure 2B:
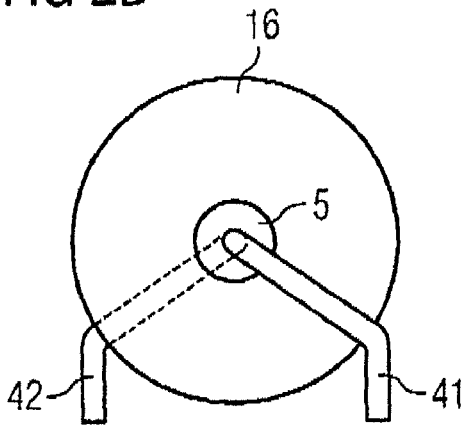

The structure of the, e.g., identically constructed resistor elements 11, 12, 13, 14 is explained in FIGS. 2A and 2B. The resistor element comprises a base body 15 and two film electrodes 16, 17, between which base body 15 is arranged.

A first connection wire 41 is connected to first electrode 16 of the resistor element, and a second connection wire 42 is connected to second electrode 17. A means of connection is soldering. Soldering points 5, which increase the overall thickness of the resistor element, are formed at the connection points of electrodes 16, 17 and connection wires 41, 42.

Figure 5:
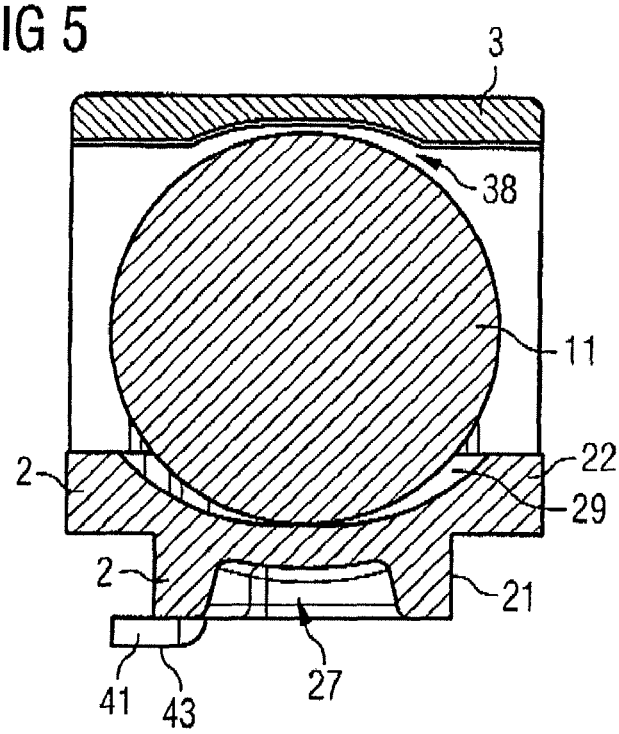
FIG. 5, the assembly of FIG. 1 in cross section.
Figure 6:
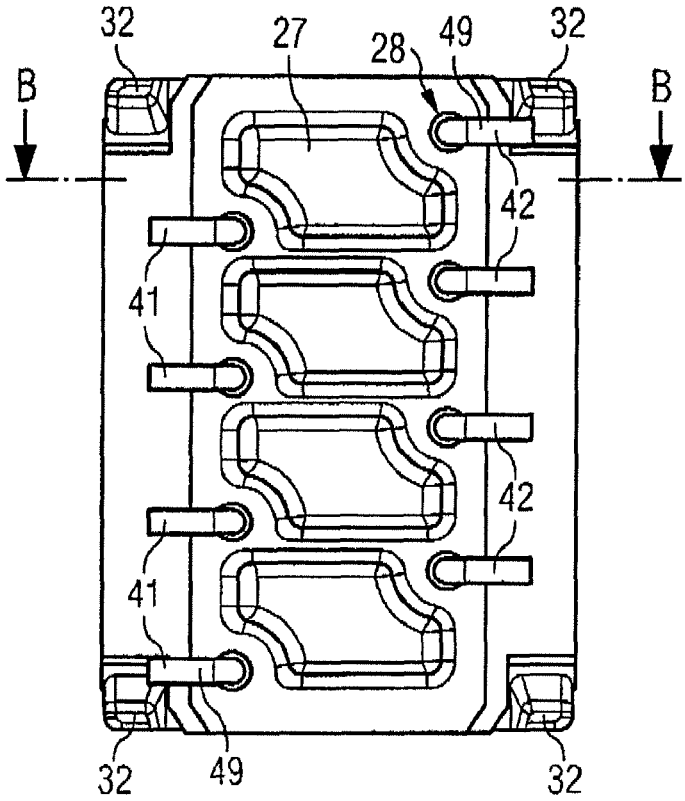
FIG. 6, a plan view onto the underside of the assembly according to FIG. 1.
Figure 7:
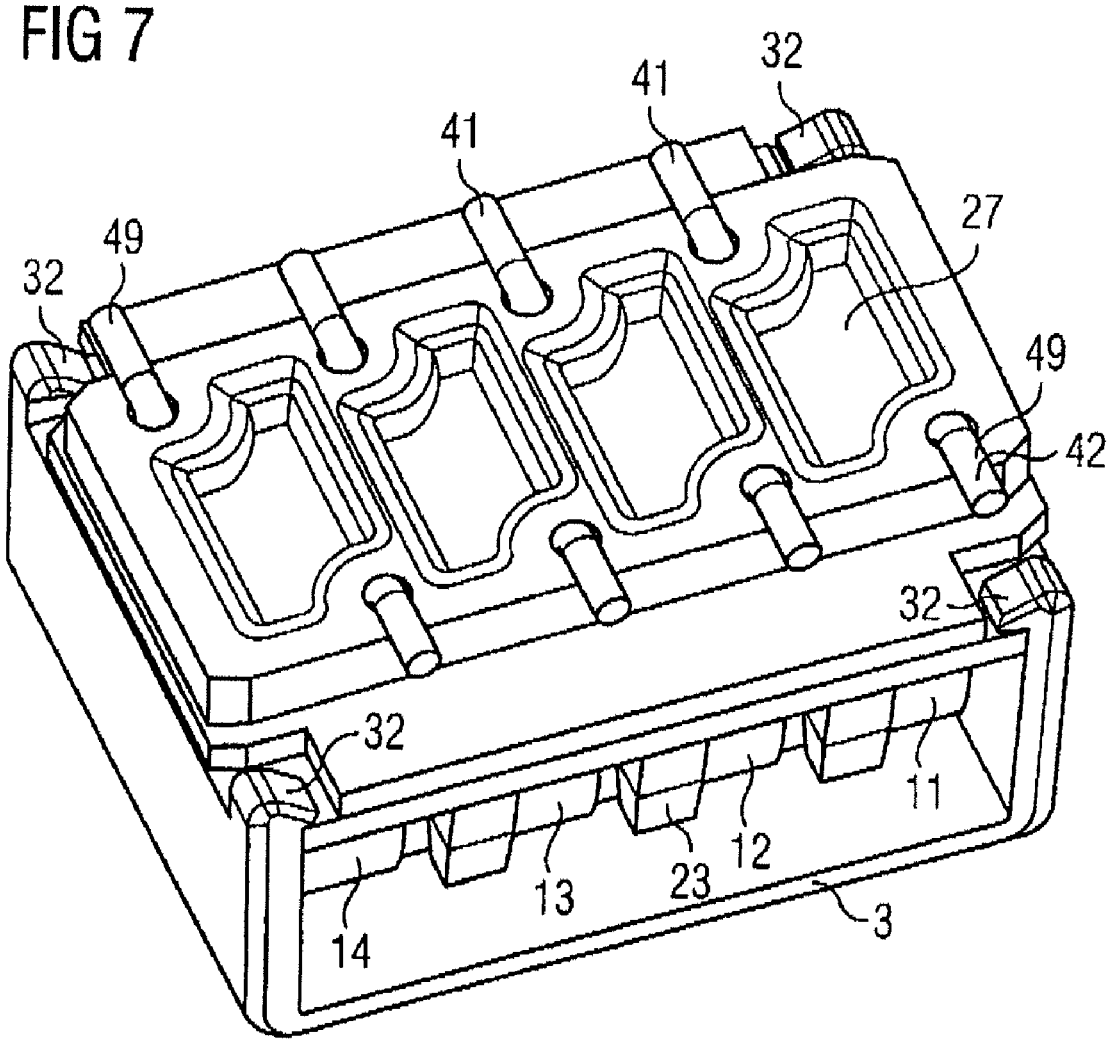
FIG. 7, the assembly according to FIG. 1 in perspective view.
Figure 8:
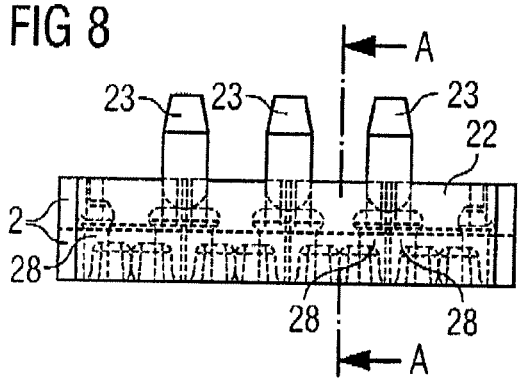
FIG. 8, the carrier plate of the assembly according to FIG. 1 in longitudinal section.
Figure 9:
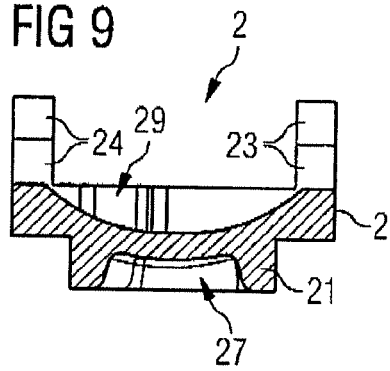
FIG. 9, the carrier plate of the assembly according to FIG. 1 in cross section.
Figure 10:
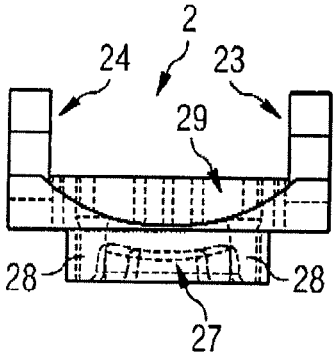
FIG. 10, the carrier plate of the assembly according to FIG. 1 in partial cross section.
Figure 11:
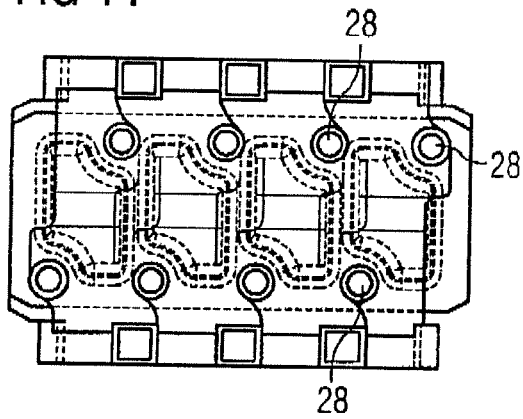
FIG. 11, a plan view onto the underside of the carrier plate for the assembly according to FIG. 1.

Soldering point 5 may be situated roughly in the center of the main surface of the resistor element or of electrode 16, 17. Deviations from this are possible. A certain distance between the soldering point and the lowest point of the resistor element is advantageous, except in the case—as shown in FIG. 5—that the lower area of the resistor element is to be lowered into a recess 29 of carrier plate 2.

In an advantageous variant, the resistor element, apart from connection wire 41, 42, is covered by an electrically insulating envelope 6. This envelope also covers soldering points 5. Two resistor elements to be kept electrically insulated from one another can therefore be separated by a particularly short distance. Minimum spacing d2 between soldering points 5 of adjacent resistor elements is, for example, 0.2 to 0.3 mm, cf. FIG. 4.

The envelope 6 may have a uniform thickness that may be up to 200 micrometers. An insulating lacquer applied with a spray method, for instance, is particularly suitable as a material for the envelope. For sufficient edge covering, it is advantageous if the base body has no sharp edges. Its edges can be flattened by beveling, for example. Rounded edges are also advantageous.

Connection wires 41, 42 are led such that they have an area running at an inclination. This area extends along the main surface of the resistor element; see FIG. 2B. Second connection wire 42 may form an angle to first connection wire 41. This angle can be between 60° and 120°, for instance. In its further extension, connection wire 41, 42 is angled or bent such that its lower area is oriented essentially vertically.

Connection wire 41, 42 is led through an opening 28 of carrier plate 2. The diameter of opening 28 may be greater than that of connection wire 41, 42.

The end of connection wire 41, 42 serving for electrical contacting of the resistor element, which protrudes from the carrier plate, may be bent such that it is oriented parallel to the base surface of the carrier plate. This free wire end has a contact area 43 that forms an external contact of the resistor element and the assembly.

Figure 2C:
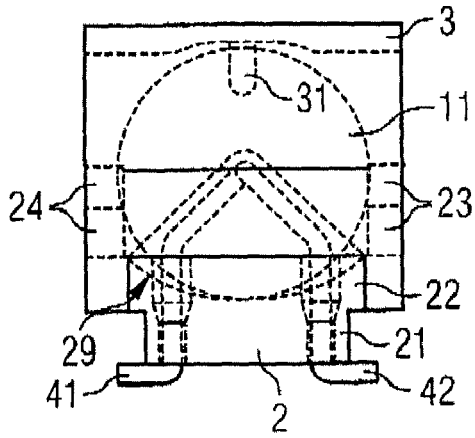
FIG. 2C, the assembly according to FIG. 1 in a partial cross section.
Figure 3:
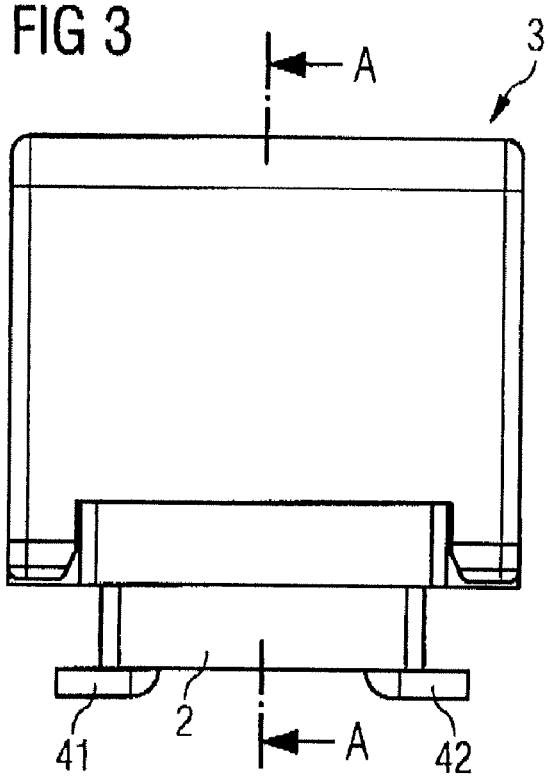
FIG. 3, a second side view of the assembly according to FIG. 1.

The carrier plate has a base area 21 and an upper area 22, which form a step, since base area 21 is lowered with respect to upper area 22; see FIG. 2C. Contact area 43 at the end of contact wires 41, 42 is thereby made accessible for contact with the probe tip of a test device.

The carrier plate has recesses 27 that are arranged on the underside. The purpose of these recesses, among others, is to save material in the manufacture of the carrier plate. These recesses have a nonflat bottom so that the minimum strength of carrier plate 2 is guaranteed despite recesses 29.

Each of the four recesses 29 is provided to accommodate a lower area of resistor element 11, 12, 13, 14.

In principle, the disk-shaped resistor element can be displaced laterally by rolling in relation to its starting position after installation in the carrier plate. This can be detrimental, because the length of the projecting wire ends can be changed. In particular, one external contact can become longer than the other, which may impair the mechanical properties of the assembly.

To prevent rolling of the disk-shaped resistor element, the bottom of recess 29 is formed sufficiently uneven, in particular, rising towards the outside, that restoring forces result in case of lateral displacement of the resistor element, which bring the resistor element back into its initial position. In cross section, the bottom of recess 29 may follow the shape of a circle with a radius larger than that of the resistor element.

Figure 12:
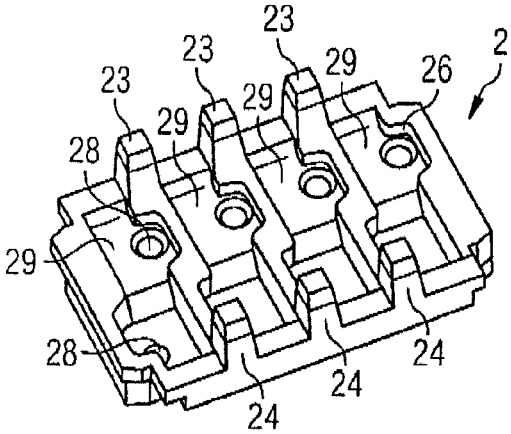
FIG. 12, the carrier plate for the assembly according to FIG. 1 in a perspective view from above.
Figure 13:
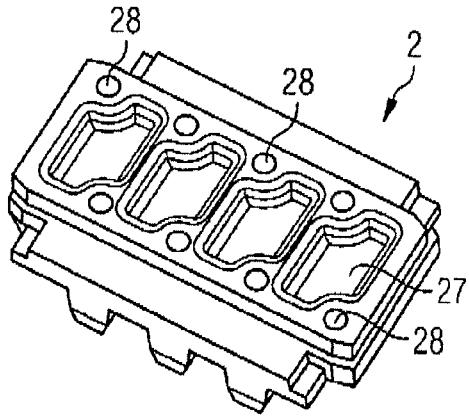
FIG. 13, the carrier plate for the assembly according to FIG. 1 in a perspective view from below.
Figure 14:
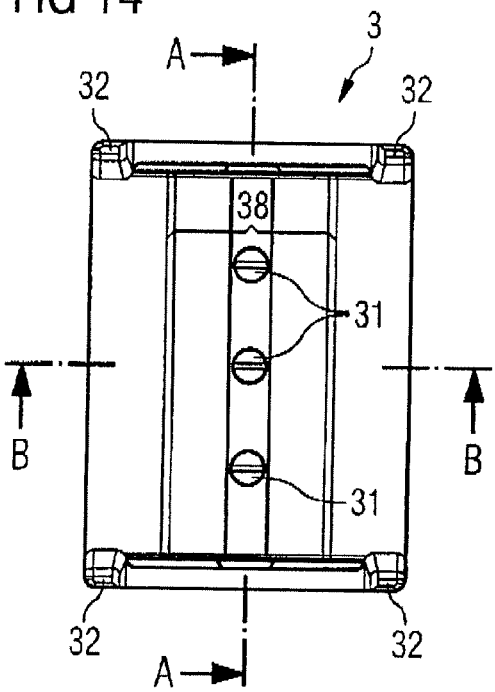
FIG. 14, a plan view onto the underside of the cover for the assembly according to FIG. 1.
Figure 15:
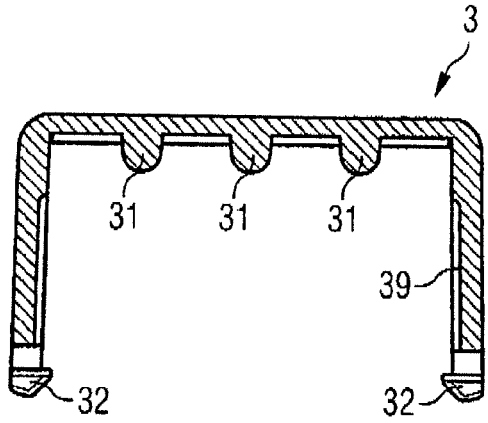
FIG. 15, the cover of the assembly according to FIG. 1 in longitudinal section.
Figure 16:
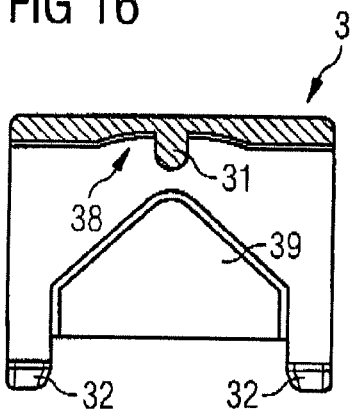
FIG. 16, the cover of the assembly according to FIG. 1 in partial cross section.
Figure 17:
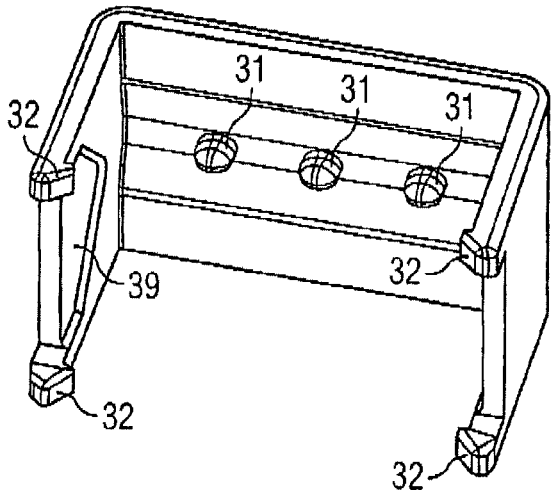
FIG. 17, the cover of the assembly according to FIG. 1 in a perspective view.

Carrier plate 2 has a cutout 26 as shown in FIG. 12, in which a part of outward-facing connection wire 49 of endmost resistor element 11 or 14 is accommodated.

The assembly has a cover 3 having two open sides. Cover 3 is fastened by means of catch devices 32 to the front and rear sides of carrier plate 2.

Cover 3 has a first recess 38, which extends in the longitudinal direction of the assembly. This recess has the form of a shallow and relatively wide groove. Upper areas of resistor elements 11-14 project into this recess. It serves as a positioning element that, similarly to recess 29 of carrier plate 2, counteracts the rolling of the resistor elements. The bottom of first recess 38 is somewhat flattened so that a predetermined minimum thickness of cover 3 is guaranteed in the area of this recess.

Cover 3 has end walls, that may be oriented essentially parallel to the main surfaces of resistor elements 11-14 and perpendicular to the longitudinal direction of the assembly.

Each end wall has an inward-facing second recess 39, which is provided for accommodating outward-facing soldering point 5 of the longitudinally outermost resistor element. Again, the depth of recess 39 is chosen so that the minimum thickness of the cover is maintained.

Cover 3 has centering devices 31 in the form of nubs, which are arranged between resistor elements 11, 12, 13, 14 and prevent them from tilting out of the vertical orientation.

Recesses 29 of the carrier plate 2 and recess 38 of cover 3 are advantageous because, among other things, they serve to reduce the overall height of the assembly.

Spacers 23, 24 are thinned towards the top to facilitate the insertion of the resistor elements.

The design possibilities for these assemblies, particularly with respect to the shape of the components of the carrier plate and the cover, are not exhausted by the variant presented in the figures. The recesses and cutouts can be shaped as desired. Additional recesses or openings can also be provided. The cover can be riveted, screwed or glued to the carrier plate. The number of resistor elements may be greater or less than four.

The footprint of the assembly may be 115 $mm^2$ or less. Its volume may be 1175 $mm^3$ or less.

The carrier plate and the cover may be constructed as molded parts such as injection-molded parts. They can be made of plastic, in particular a polymer-based plastic.

The invention claimed is:

1. An electrical assembly, comprising:

at least two PTC-resistor elements, each of the at least two PTC-resistor elements having a base body having a flat shape, each base body having main surfaces that contain electrodes; and a carrier plate having spacers for positioning base bodies of the at least two PTC resistor elements;

wherein a width of each spacer is about equal, in at least one area, to a distance between facing electrodes of adjacent PTC-resistor elements.

2. The electrical assembly of claim 1, wherein each base body is vertically oriented.

3. The electrical assembly of claim 1, further comprising a connection wire attached to each electrode of a corresponding PTC-resistor element.

4. The electrical assembly of claim 3, comprising between two adjacent PTC-resistor elements, at least two spacers, wherein connection wires of the two adjacent PTC-resistor elements are among the at least two spacers.

5. The electrical assembly of claim 3, wherein the carrier plate comprises openings through which connection wires pass.

6. The electrical assembly of of claim 1, wherein areas of PTC-resistor elements are in recesses of the carrier plate.

7. The electrical assembly of to claim 6, wherein recesses of the carrier plate have depths that increase in cross-section from an interior towards an exterior in opposite directions.

8. The electrical assembly of one of claim 1, further comprising at least one cover fixed to the carrier plate.

9. The electrical assembly of claim 8, wherein the at least one cover comprises centering devices between PTC-resistor elements.

10. The electrical assembly of claim 8, wherein the at least one cover comprises at least one recess for accommodating an area of at least one PTC-resistor element; and wherein the at least one recess in the cover has a depth that increases in cross-section from an interior towards an exterior in opposite directions.

11. The electrical assembly of claim 8 wherein the cover comprises end walls that comprise additional recesses; and wherein outward-facing connection wires of endmost PTC-resistor elements interface to the additional recesses.

12. The electrical assembly of claim 11, wherein the at least two PTC-resistor elements comprise at least four mutually electrically isolated PTC resistor elements that are aligned by spacers relative to one another so that main surfaces of the at least four mutually electrically isolated PTC resistor elements are oriented in parallel.

13. The electrical assembly of claim 1, wherein each spacer decreases in thickness upwardly along a longitudinal section.

14. The electrical assembly of claim 3, wherein the carrier plate comprises has at least one cutout that interfaces to an outward-facing connection wire of each endmost PTC-resistor element.

15. The electrical assembly of claim 1 wherein a maximum thickness of each base body is 1.5 mm.

16. The electrical assembly of claim 1, wherein a distance between two adjacent PTC-resistor elements is 1.6 mm at maximum.

17. The electrical assembly of claim 3, wherein a minimum distance between facing connection wires of adjacent PTC-resistor elements is less than 0.5 mm.

18. The electrical assembly of claim 3, further comprising an electrically-insulating envelop to cover the PTC-resistor elements and soldering points.

* * * * *

UNITED STATES PATENT AND TRADEMARK OFFICE

CERTIFICATE OF CORRECTION

PATENT NO. : 7,986,214 B2
APPLICATION NO. : 11/937098
DATED : July 26, 2011
INVENTOR(S) : Werner Kahr It is certified that error appears in the above-identified patent and that said Letters Patent is hereby corrected as shown below:

Column 8, Line 4, Claim 6;
Delete "of of" and Insert -- of --

Column 8, Line 6, Claim 7;
Delete "of to" and Insert -- of --

Column 8, Line 9, Claim 8;
Delete "of one of" and Insert -- of --

Signed and Sealed this
Tenth Day of January, 2012

David J. Kappos

David J. Kappos
*Director of the United States Patent and Trademark Office*